US006864633B2

(12) United States Patent
Trail et al.

(10) Patent No.: US 6,864,633 B2
(45) Date of Patent: Mar. 8, 2005

(54) X-RAY SOURCE EMPLOYING A COMPACT ELECTRON BEAM ACCELERATOR

(75) Inventors: Mark E. Trail, Menlo Park, CA (US); David H. Whittum, Scottsdale, CA (US); Gard E. Meddaugh, Mountain View, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 92 days.

(21) Appl. No.: 10/407,101

(22) Filed: Apr. 3, 2003

(65) Prior Publication Data

US 2004/0195971 A1 Oct. 7, 2004

(51) Int. Cl.[7] ..... H01J 25/10
(52) U.S. Cl. ..... 315/5.41; 315/505
(58) Field of Search ..... 315/5.41, 5.42, 315/5.39, 500, 505

(56) References Cited

U.S. PATENT DOCUMENTS

| | | | | |
|---|---|---|---|---|
| 4,024,426 A | | 5/1977 | Vaguine | 315/5.41 |
| 4,122,373 A | | 10/1978 | Vaguine | 315/5.41 |
| 4,155,027 A | * | 5/1979 | Schriber et al. | 315/5.41 |
| 4,160,189 A | | 7/1979 | Tran et al. | 315/5.41 |
| 4,286,192 A | | 8/1981 | Tanabe et al. | 315/5.41 |
| 4,639,641 A | | 1/1987 | Tronc | 315/5.41 |
| 4,975,652 A | | 12/1990 | Tronc | 315/505 |
| 4,988,919 A | | 1/1991 | Tanabe et al. | 315/5.41 |
| 5,381,072 A | | 1/1995 | Tanabe | 315/5.41 |
| 5,734,168 A | * | 3/1998 | Yao | 250/492.3 |
| 6,366,021 B1 | | 4/2002 | Meddaugh et al. | 315/5.41 |
| 6,465,957 B1 | * | 10/2002 | Whitham et al. | 315/5.41 |
| 6,493,424 B2 | * | 12/2002 | Whitham | 378/137 |
| 6,646,383 B2 | * | 11/2003 | Bertsche et al. | 315/5.41 |
| 6,657,391 B2 | * | 12/2003 | Ding et al. | 315/5.41 |

OTHER PUBLICATIONS

J. Gonichon, D. Tronc,"Acceleration and Bunching in a 6MV X Band Linac", GE Medical Systems, 3 pgs.

J. Mckeown and S.O. Schriber, "Accelerating Structure with On–Axis Couplers For Electron Storage Rings", IEEE Transactions on Nuclear Science, vol. NS–28, No. 3, Jun. 1981, pp. 2755–2757.

D. Tronc, A. Setty, "Electrons RF Auto–Focusing and Capture in Bunchers", General Electric CGR MeV, BP 34, 78530 Buc, France, WE–19, pp. 353–355.

* cited by examiner

*Primary Examiner*—Wilson Lee
*Assistant Examiner*—Ephrem Alemu
(74) *Attorney, Agent, or Firm*—Dorsey & Whitney

(57) ABSTRACT

A standing wave electron beam accelerator and x-ray source is described. The accelerator has a plurality of on-axis resonant cells having axial apertures electrically coupled to one another by on-axis coupling cells having axial apertures. The accelerator includes a buncher cavity defined in part by an apertured anode and a half cell. The buncher cavity is configured to receive electrons injected through said anode aperture and r.f. focus them into a beam which is projected along the axis through said apertures. An x-ray target is supported in spaced relationship to said accelerator by a support having a smaller diameter than the accelerator.

18 Claims, 5 Drawing Sheets

X-RAY SOURCE EMPLOYING A COMPACT ELECTRON BEAM ACCELERATOR

BRIEF DESCRIPTION OF THE INVENTION

This invention relates generally to x-ray sources employing standing wave electron beam accelerators, and more particularly x-ray sources employing compact high-energy electron beam accelerators having low-leakage x-ray radiation to minimize shielding requirement.

BACKGROUND OF THE INVENTION

Standing wave type linear accelerators generate high-energy electron beams which strike metallic targets to generate x-rays. The linear accelerators have a series of linearly arranged cavity resonators separated by apertured walls. The apertures define a passage through which the electron beam travels to interact with standing waves supported in the cavities. The beam gains energy as it travels through successive resonant cavities. The electrons are injected into the first cavity at relatively low energy by an electron gun. The electron beam is accelerated as it travels through the cavities. Electrons which strike cavity walls during their travel through the accelerator not only reduce the electron current reaching the x-ray target but also generate undesirable leakage x-ray radiation. The electrons striking the target generate x-rays which are emitted in all directions. Forward traveling x-rays are intercepted by a beam blocker which includes an aperture which defines the shape of the desired beam. The accelerator and the target region are shielded to absorb the leakage x-ray radiation and the target radiation except for the desired radiated beam. The x-ray shielding adds weight and size to the x-ray source.

SUMMARY OF THE INVENTION

It is a general object of an invention to provide a compact linear accelerator in which the beam energy is maximized and leakage x-ray radiation is minimized.

It is another object of the invention to provide a buncher cell with an anode plate which incorporates rf focusing to establish beam size with good electron capture.

It is another object for an invention to provide a linear accelerator with an extended x-ray target which enables shielding of reduced size and weight.

It is a further object of the present invention to provide a linear accelerator having ultra-low leakage x-ray radiation.

It is a further object of the present invention to provide on-axis coupling cells to insure undistorted circular beams by eliminating asymmetric perturbations caused by side cavity coupling holes.

It is a further object of the invention to provide an accelerator having a large aperture beam tunnel to minimize electron interception and reduce leakage x-ray radiation.

It is another object of the invention to provide a compact linear accelerator having low leakage radiation thereby reducing the amount of shielding required with the consequent reduction of the overall size and weight of the x-ray source.

It is another object of the invention to provide an x-ray target that is moved away from the accelerator to simplify target shielding.

It is still another object of the present invention to provide a compact linear accelerator which is simple in design and easy to manufacture.

The foregoing and other objects of the invention are achieved by an x-ray source having a linear accelerator including an electron source that injects electrons into a buncher cell configured to capture and rf focus the injected electrons to establish an electron beam, linearly arranged resonant large-aperture cells that support standing waves through which the beam travels to interact with the standing waves and be further accelerated, and an extended target which generates x-rays in response to the electron beam.

BRIEF DESCRIPTION OF THE DRAWINGS

The invention will be better understood from the following descriptions when read in conjunction with accompanying drawings in which.

DESCRIPTION OF PREFERRED EMBODIMENTS

Figure 1:
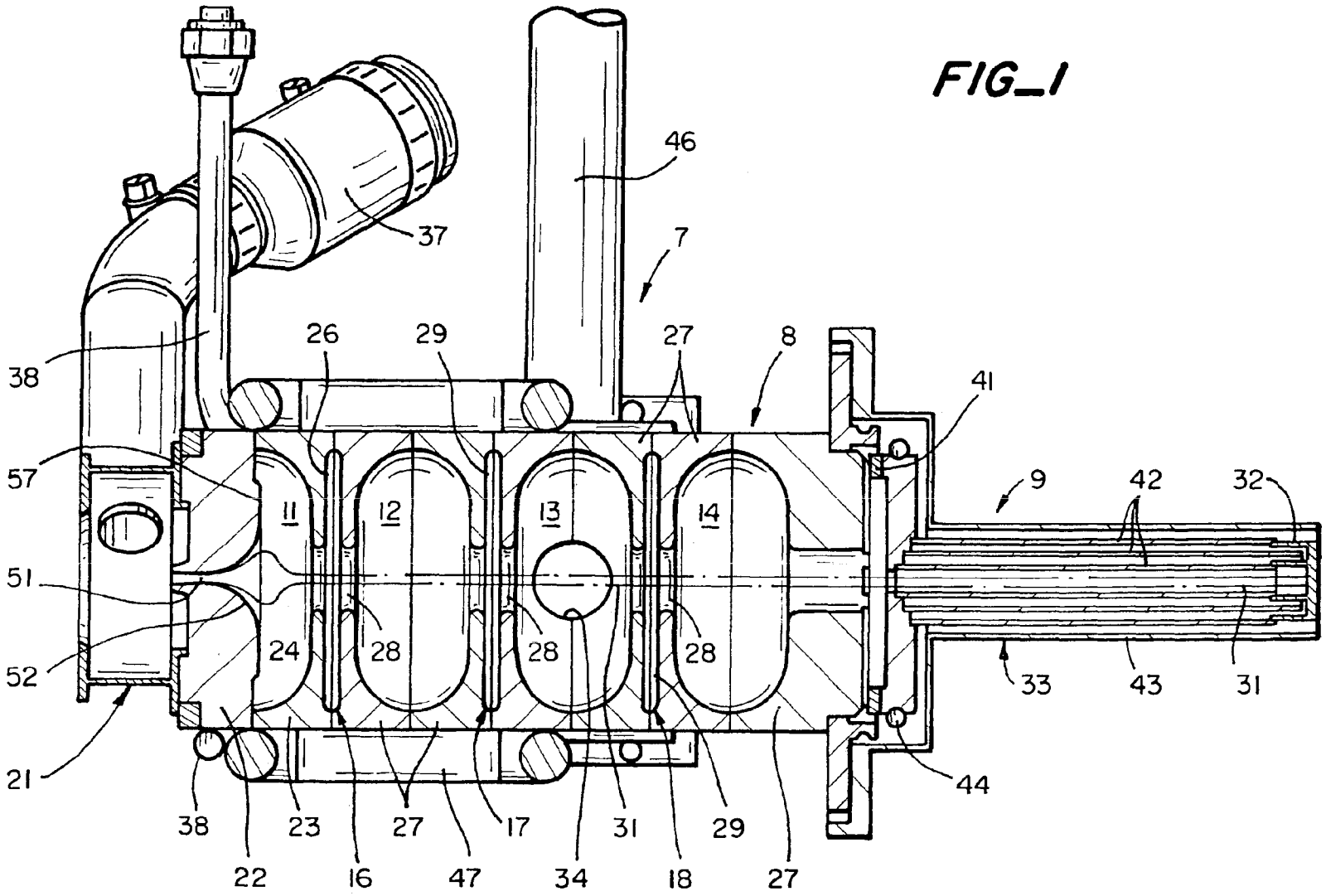
FIG. 1 is a longitudinal cross-sectional view of a standing wave electron beam accelerator and x-ray source.
Figure 2:
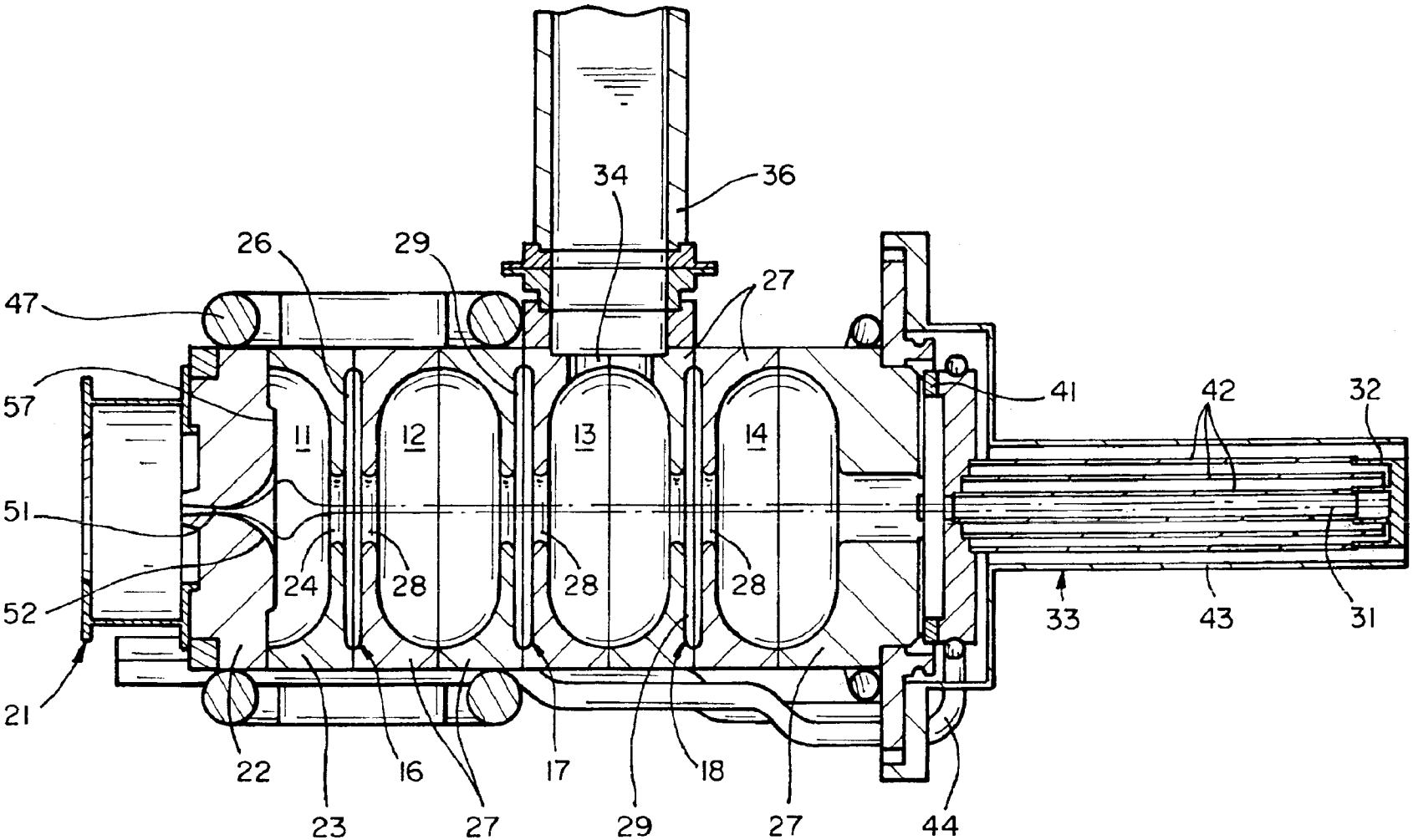
FIG. 2 is a longitudinal cross-sectional view of the standing wave electron accelerator and x-ray source taken at 90 degrees with respect to the cross-sectional view of FIG. 1.

FIG. 1 is an axial sectional view of an x-ray source 7 including a standing wave electron beam accelerator structure 8 and extended target 9 in accordance with one embodiment of the present invention. It comprises a chain of electrically coupled resonant cells or cavities. The cells comprise a buncher cell 11 and in-line resonant cells 12, 13 and 14. The cells are electrically coupled by on-axis coupling cells 16, 17 and 18 formed by joining facing half-cells. Electrons are injected into the buncher cell 11 by an electron gun 21, which includes an anode plate 22 that forms one wall of the buncher cell 11. The other walls of the buncher cell are formed by the cup-shaped half-cell 23 which includes an iris or opening 24. The half cell includes an outer recessed region 26. Each of the remaining cells 12, 13 and 14 are formed by identical cup shaped half cells 27 which include beam tunnel irises or openings 28 and outer recesses 29. When the half-cell 23 and anode plate 22 are joined to one another they form the on-axis buncher cell 11. On-axis resonant accelerating cells 12, 13 and 14 are formed by joining cup-shaped members 27. Recesses 26 and 29 form the on-axis coupling cells 16, while recesses 29 form coupling cells 17 and 18. The axially aligned irises or openings 24, 28 are aligned with the axis of the electron gun and form a tunnel for passage of the axial electron beam 31. The beam 31 strikes a tungsten target or button 32 at the end of an extended coaxial water-cooled target assembly 33. Microwave energy is applied to the central resonant cell 13 through an iris 34 (of any shape) via a rectangular waveguide 36, FIG. 2. Standing waves are induced in the resonant cells by the applied microwave energy. Operating voltages are applied to the electron gun via a high voltage connector 37. The linear accelerator may be water cooled as illustrated by the tubing 38.

The extended water-cooled target assembly 9 may be electrically isolated from the accelerator by a ceramic insulator 41. The target button is supported by coaxial conducting members 42. The ceramic members are protected by a metal shroud 43. The target is water cooled via the water cooling lines 44, FIG. 2. The cooling water flows between the coaxially arranged ceramic members 42. The linear accelerator is evacuated via tubulation 46. The accelerator may include electrical steering coils 47 for guiding the electron beam.

The frequency of the microwave energy is selected such that the chain of coupled resonant cells are excited with standing waves with a $\pi/2$ radian phase between each coupling cell and adjacent accelerating or resonant cell. Thus, there is $\pi$ radian shift between adjacent accelerating resonant cavities or cells 11, 12, 13 and 14. The $\pi/2$ mode has several advantages. It has the greatest separation of resonant frequency from adjacent modes, which might be accidentally excited. Also when the chain is properly terminated there are very small electromagnetic fields in the coupling cells 16, 17 and 18 so that the power losses in these non-interacting cavities are small. The space between the resonant cavities is about one-half of a free space wavelength so that electrons accelerated in one accelerating cell will arrive at the next accelerating cell in the proper phase relative the microwave field for additional acceleration. After being accelerated the beam 31 strikes the x-ray target button 32. Alternately, the linear accelerator may be provided with a thin metal window, which transmits electrons for other radiation purposes. The members 23 and 27 forming on-axis resonant coupling cells are of identical design and have mirror image symmetry whereby all of the resonant cavities will be substantially the same. Furthermore, the cup-shaped members 23 and 27 are easy to fabricate and the accelerator is easy to assemble.

Figure 3:
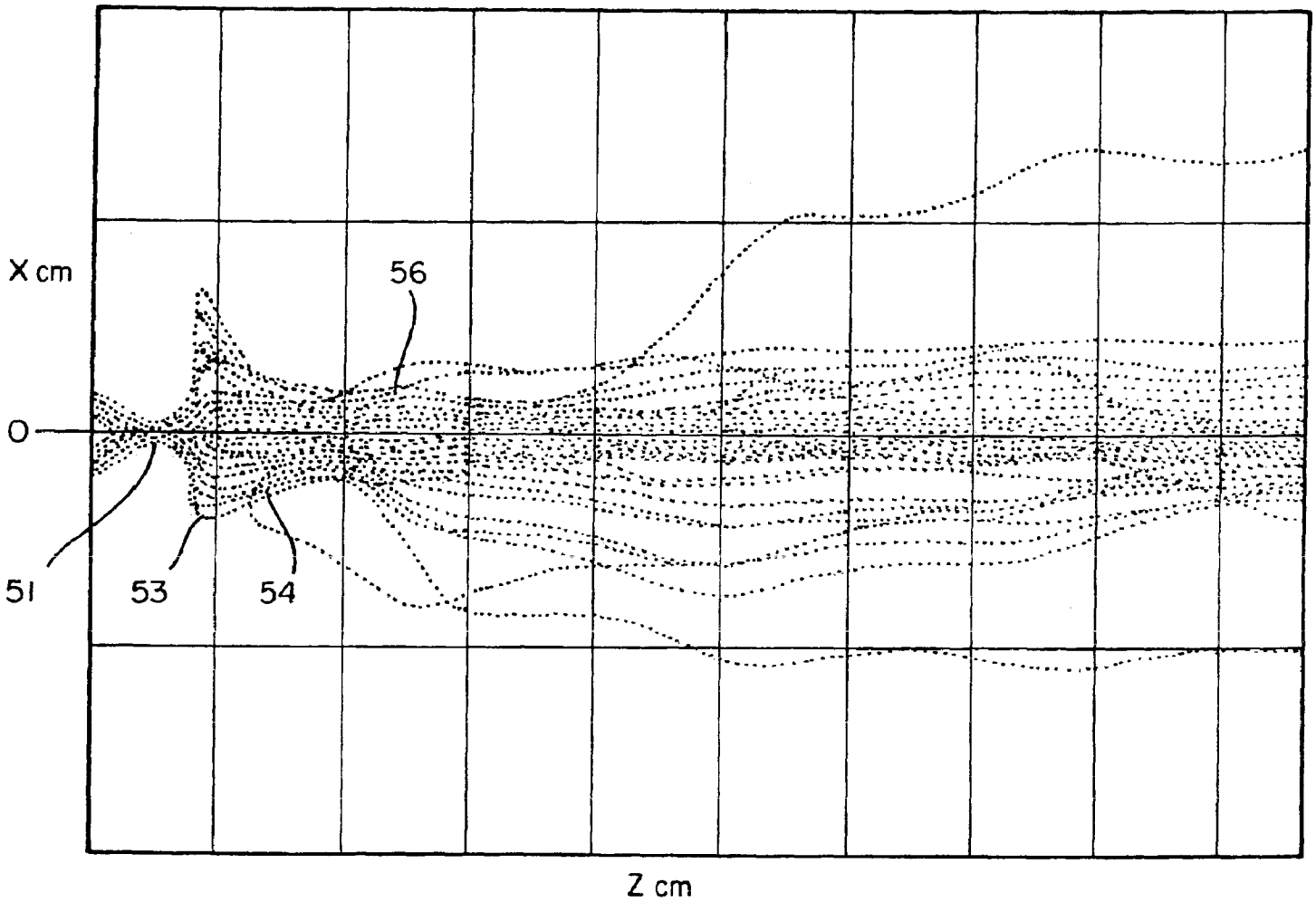
FIG. 3 schematically shows the shape of the electron beam as it is injected in to the buncher cavity and as it travels through the linearly-arranged resonant cavities.

In accordance with one feature of the present invention, the buncher cavity 11 is configured to bunch and focus the injected electrons to form a beam and to establish its size while capturing the maximum number of electrons injected into the cavity. The electrons from the electron source are focused at location 51 within the anode aperture 52. This aperture has a trumpet shape which bunches and captures the electrons as they are injected into the buncher cell 11. To this end, the anode plate 22 has a thickness that places the electron waist, FIG. 3, at the optimum location 51, for later rf focusing. Focusing is achieved without an external solenoid. The trumpet-shaped anode aperture 52, FIGS. 1 and 2, opens into the buncher cell to establish rf fields within the buncher cell which cause the beam to be focused. The beam expands 53 within the trumpet and is focused by the large radial fields it then encounters (FIG. 3). The beam is then rf refocused 54 to establish the beam size 56, FIG. 3, at the iris or aperture 24, FIG. 1. The buncher cell length is designed to place the captured beam near the crest of the rf accelerating field within the buncher cavity. Plateau on shorting plate 57 formed on the wall of the anode compensates for detuning due to the trumpet. The combination of trumpet, plateau and cavity geometries provides a resonantly tuned, high Q cell necessary for low power operation and short cell length necessary for low voltage injection. The on-axis coupling cells 29 provide additional focusing. The bi-periodic design permits reduced sensitivity to tuning errors. Preferably, the irises and beam-passing tunnel are of large diameter to minimize stray radiation caused by interception of stray electrons. We have found that, at the design operating voltages, less than 0.6% of the injected beam is lost in the guide. The remainder of the beam is either rejected at the buncher cell or makes its way to the target. This results in reduced guide glow (stray radiation), which minimizes the required x-ray shielding required. Furthermore, the accelerator does not use external coupling cavities. As a result, the diameter of the accelerator is reduced, which enables shielding to be located close to the accelerator body, significantly reducing the volume and weight of the shielding material. The accelerator delivers a converging beam to the extended target.

Figure 4:
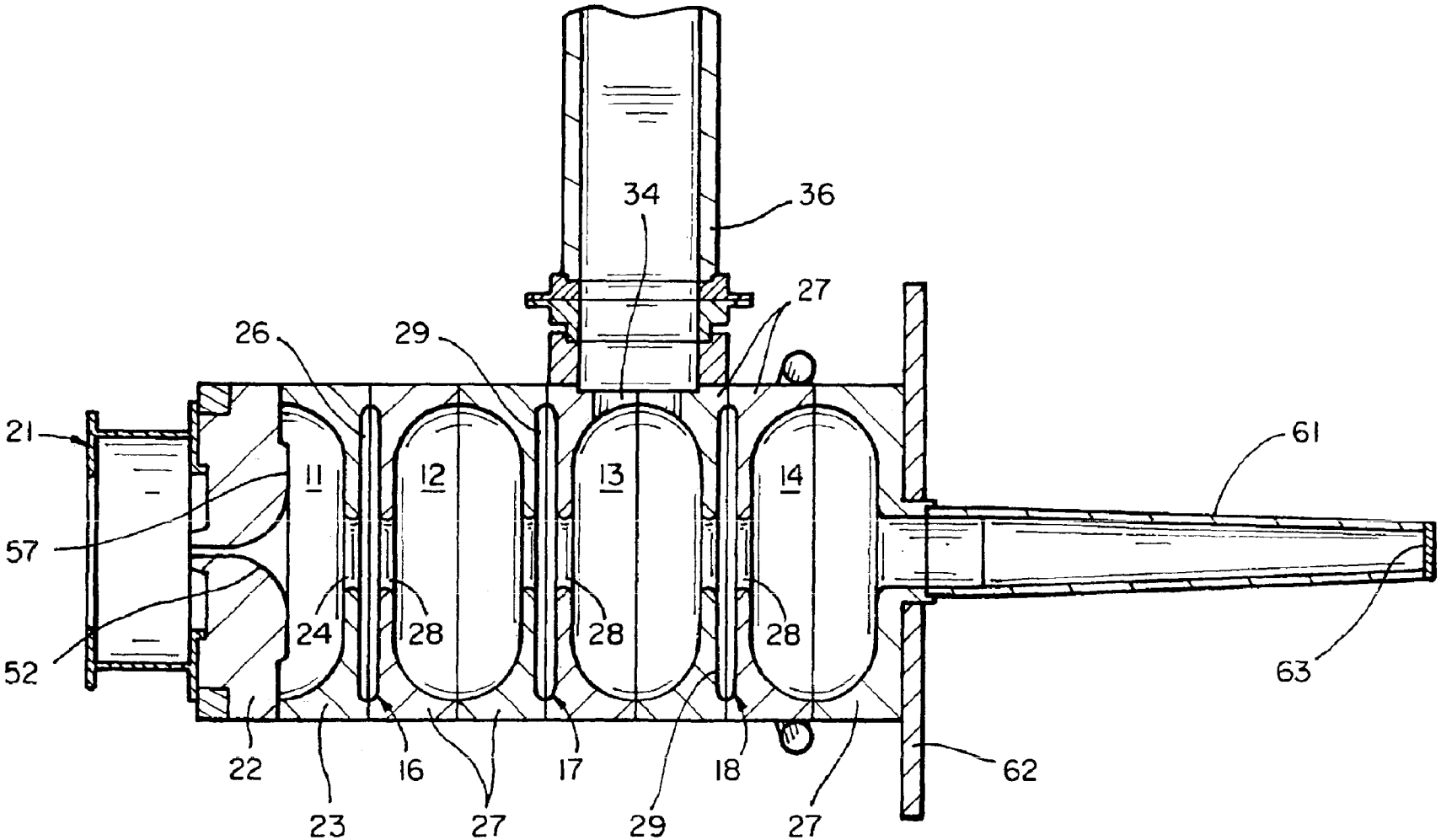
FIG. 4 shows a longitudinal cross-sectional view of an electron accelerator and x-ray source in accordance with another embodiment of the invention.

An alternate construction of the extended target is illustrated in FIG. 4 where like reference numerals have been applied to like parts. The extended target comprises a tapered extended x-ray target support 61 that is mounted to the accelerator by a mounting flange 62. The target support may be a dense material such as Elkonite, for improved shielding, or copper. The target is conduction-cooled simplifying the manufacturing process and thereby reducing manufacturing costs. The tapered walls allow a gradual interception of outlying electrons and enables increasing thickness of shielding around the target button. The small radius of the extended target in comparison to that of the accelerator permits placing the x-ray shielding closer to the target and minimizes the weight and size of the accelerator and x-ray source and shielding assembly.

Figure 5:
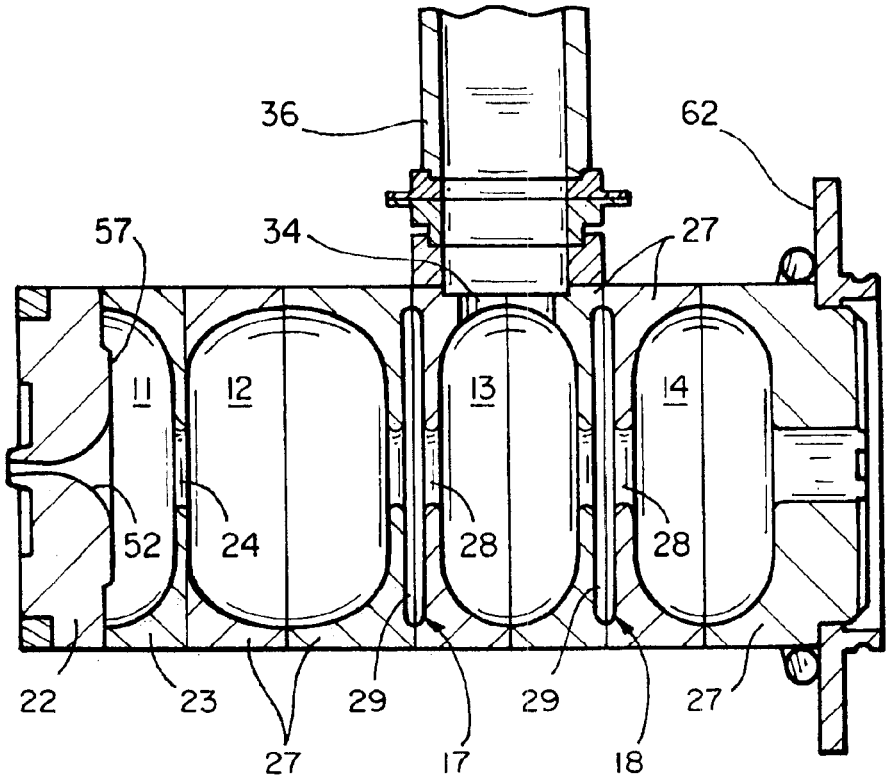
FIG. 5 is a longitudinal cross-sectional view of the accelerator details of still another embodiment of the invention.

Another embodiment of the present invention is illustrated in FIG. 5 where like reference numerals have been applied to like parts. The buncher cavity or cell 11 and the first cell or cavity 12 are 180 degrees or $\pi$ radians apart in phase. Use of the $\pi$ mode electron capture section or cell 12 coupled to the $\pi/2$ downstream cells permits a sharper energy spectrum for low injection voltage, while maintaining the high quality factor (Q) desired to minimize power requirements. The end result is bunching, phasing and focusing of injected beam electrons with minimal guide glow. Low injection voltage permits low radiation output at high energy.

Figure 6:
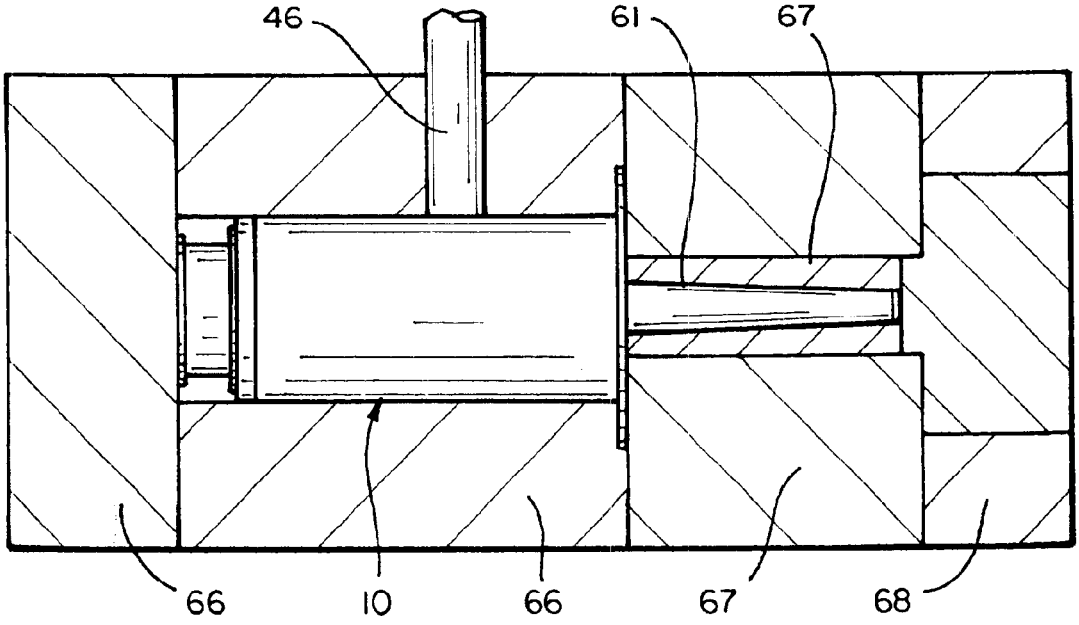
FIG. 6 is a longitudinal cross-sectional view of an x-ray source and its shielding.

FIG. 6 schematically shows shielding associated with the embodiment of FIG. 4. The accelerator 10 is shown encased in shielding material 66, and the extended target is shown in shielding material 67. Shielding material 68 and any associated beam blocker shields against unwanted radiation other than desired radiation emitted in the forward direction. The shielding material can be lead or, to reduce size, a dense material well-known in the shielding art. Thus there has been provided a compact efficient low stray radiation linear accelerator and x-ray source.

What is claimed is:

1. A standing wave electron beam accelerator comprising:

an electron source;

a buncher cell;

an apertured anode forming one wall of said buncher cell serving to receive electrons from said electron source and inject them into said buncher cell, said aperture and said cell configured to capture and r.f. focus the injected electrons into an electron beam, and at least two on-axis $\pi/2$ mode coupled resonant cells for receiving said electron beam, whereby standing waves in said cells interact with and add energy to the beam.

2. A standing wave electron beam accelerator as in claim 1 in which said anode aperture is trumpet-shaped with the large open end facing into the buncher cell.

3. A standing wave electron beam accelerator as in claim 2 wherein said anode includes a shorting plate surrounding the open end of said aperture.

4. A standing wave electron beam accelerator as in claim 1, 2 or 3 including a target for intercepting the electron beam and emitting x-rays and support means having a diameter less than that of the accelerator body for supporting the target spaced from the accelerator body.

5. A standing wave electron beam accelerator as in claim 4 in which the support and target are water cooled.

6. A standing wave electron beam accelerator as in claim 4 in which the target and support are cooled by conducting heat to the accelerator body.

7. In an accelerator for accelerating an electron beam:

a chain of resonant electromagnetic cells disposed along an axis and coupled in series by intermediate coupling cavities disposed along said axis;

a buncher electromagnetic cell coupled to one end of said series of cells by an on-axis coupling cell; and an electron source including an apertured anode forming one wall of said buncher cell serving to inject electrons from said source into said buncher cell, said buncher cell and said anode aperture configured whereby the injected electrons are captured and rf focused into an electron beam which travels through said resonant and coupling cavities.

8. An accelerator as in claim 7 in which said anode aperture is trumpet-shaped with the large end of said aperture extending into said buncher cell.

9. A accelerator as in claim 8 wherein said anode includes a shorting plate surrounding the open end of said aperture.

10. An accelerator for accelerating an electron beam comprising:

a chain of resonant electromagnetic cells formed by identical cup-shaped half-cells facing one another;

coupling cells formed by recesses in the abutting ends of cup-shaped half-cells of adjacent cells; and a buncher cell formed by one of said identical cup-shaped half-cells and an apertured anode, the recesses of said cup-shaped members abutting the cup-shaped half-cell of the first resonant cell to form a coupling cell, said apertured anode injecting electrons from an electron source into said buncher cell wherein said anode aperture and cup-shaped half-cell are configured to support rf fields which capture, bunch and focus said injected electrons into a beam which passes through said resonant cavities.

11. An accelerator for accelerating an electron beam comprising:

at least two on-axis $\pi/2$ coupled resonant cells including central apertures linearly arranged along an axis for receiving and accelerating an electron beam as it travels through the cells, each of said cells including identical cup-shaped apertured half-cells facing each other;

an electron source;

an apertured anode with the aperture aligned with said axis serving to receive and transmit electrons from said source; and an identical half-ell facing and connected to said anode to form a buncher cell into which said transmitted electrons are injected and wherein said half-cell and anode aperture are configured to r.f. focus the electrons injected into said cell into an axial electron beam and coupling cavities formed between said buncher cell and resonant cells by abutting adjacent half-cells of adjacent cavities.

12. An accelerator as in claim 11 in which the anode aperture is trumpet-shaped.

13. An accelerator as in claim 11 or 12 including a target for intercepting the electron beam and emitting x-rays and support means having a diameter less than that of the accelerator body for supporting the target spaced from the accelerator body.

14. A standing wave electron beam accelerator as in claim 13 in which the support and target are water cooled.

15. A standing wave electron beam accelerator as in claim 13 in which the target and support are cooled by conducting heat to the accelerator body.

16. A standing wave electron beam accelerator comprising:

a buncher cell;

an apertured anode forming one wall of said buncher cell serving to receive electrons from said electron source and inject them into said buncher cell, said aperture and said cell configured to capture and r.f. focus the injected electrons into an electron beam;

a $\pi$ mode resonant cell coupled to said buncher cell; and at least two on-axis $\pi/2$ mode coupled resonant cells for receiving said electron beam, whereby standing waves in said cells interact with and add energy to the beam.

17. A standing wave electron beam accelerator as in claim 16 in which said anode aperture is trumpet-shaped with the large open end facing into the buncher cell.

18. A standing wave electron beam accelerator as in claim 17 wherein said anode includes a shorting plate surrounding the open end of said aperture.

* * * * *